United States Patent [19]

Nishiyama et al.

[11] Patent Number: 4,849,168

[45] Date of Patent: Jul. 18, 1989

[54] TI-AL INTERMETALLICS CONTAINING BORON FOR ENHANCED DUCTILITY

[75] Inventors: Yukio Nishiyama, Akashi; Takuya Miyashita, Kobe; Toshiharu Noda; Susumu Isobe, both of Nagoya, all of Japan

[73] Assignees: Kawasaki Jukogyo Kabushiki Kaisha, Kobe; Daido Tokushuko Kabushiki Kaisha, Nagoya, both of Japan

[21] Appl. No.: 120,070

[22] Filed: Nov. 12, 1987

[30] Foreign Application Priority Data

Nov. 12, 1986 [JP] Japan ..... 61-269464
Sep. 20, 1987 [JP] Japan ..... 62-236609

[51] Int. Cl.[4] ..... C22C 14/00
[52] U.S. Cl. ..... 420/418; 420/417
[58] Field of Search ..... 420/418; 1/417

[56] References Cited

U.S. PATENT DOCUMENTS

| | | | |
|---|---|---|---|
| 595,980 | 12/1960 | Finlay | 420/418 |
| 2,880,089 | 3/1959 | Vordahl | 420/418 |
| 3,008,823 | 11/1961 | McAndrew | 420/418 |
| 3,203,794 | 8/1965 | Jaffee et al. | 420/418 |
| 4,661,316 | 4/1987 | Hashimoto et al. | 420/418 |

FOREIGN PATENT DOCUMENTS

| | | | |
|---|---|---|---|
| 1061522 | 7/1959 | Fed. Rep. of Germany | 420/418 |
| 0033547 | 8/1972 | Japan | 420/418 |
| 56-41344 | 4/1981 | Japan . | |
| 61-41740 | 8/1984 | Japan . | |

*Primary Examiner*—Upendra Roy
*Attorney, Agent, or Firm*—Varndell Legal Group

[57] ABSTRACT

Disclosed are Ti-Al alloys having increased ductility and Ti-Al alloys having increased ductility and lowered melting points, in both of which the main constituent phase is an intermetallic compound, TiAl.

The Ti-Al alloys having increased ductility essentially consisting of Al: 28–38%, and B: 0.005–0.3%, the balance being Ti and inevitable impurities.

Since the alloys of this type have good processability, they are suitable as materials for mechanical parts of rotating or reciprocating systems, where high heat-resistance and high specific strength are required.

The Ti-Al alloys having increased ductility as well as lowered melting points essentially consisting of Al: 28–38%, one or two of Ni: 0.05–3.0% and Si: 0.05–3.0%, and the balance being Ti and inevitable impurities. Optionally, this alloy further contains B: 0.005–0.3%.

The alloy of this type is, in addition to the above use, suitable for producing machine parts made by precision casting technology.

6 Claims, No Drawings

TI-AL INTERMETALLICS CONTAINING BORON FOR ENHANCED DUCTILITY

BACKGROUND OF THE INVENTION

1. Field of the Invention

The present invention relates to improvement of Ti-Al alloys, particularly, alloys in which the main constituent phase is the intermetallic compound, TiAl.

2. Prior Art

Machine parts which are used under rotary or reciprocal movement, for example, turbine blades, hot wheels of turbochargers and engine valves, are recently being more and more light-weighted in order to meet the requirements of high performance such as high responce and high output. Heat-resistant materials for the above noted parts are, therefore evaluated by their specific strength (strength/density) rather than the absolute strength, and efforts are being made to improve the specific strength of these materials.

Under the circumstances, Ti-Al alloys, particularly, alloys in which the main constituent phase is intermetallic compound, TiAl, are drawing attention. The maximum usable temperature (a temperature at which the creep rupture life is 1000 hours under stress of 28.1 $Kgf/mm^2$) of TiAl is 800° C., which is higher than that of conventional titanium alloy (Ti-6Al-4V), 550° C. Moreover, the specific gravity of TiAl (3.8) is lower than that of the conventional titanium alloy (4.5) and is closer to that of ceramics (e.g., $Si_3N_4$ 3.2). TiAl has a ductility which ceramics lack, and its specific strength is higher than that of nickel-based super-alloys (e.g., Inconel 713C).

Ti-AL alloys in which the main constituent phase is TiAl, however, have lower ductility when compared with the titanium alloys and nickel-based super-alloys, and have the drawback of poor plastic workability. Efforts are being made to improve this (for example, Japanese Patent Disclosure 56-4344 discloses addition of appropriate amount of V), but have not yet reached practical use. Also, the melting point of the intermetallic compound, TiAl, exceeds 1500° C. which is higher than those of the nickel-based super-alloys for casting use (usually, 1250-1400° C.), and therefore, it is difficult to obtain defectless cast products having desired shape by conventional lost-wax method using ceramic molds due to chemical reactions between the active molten metal, TiAl, of a high temperature exceeding 1500° C. and ceramics forming the molds.

SUMMARY OF THE INVENTION

Accordingly, our intention is to solve the above described problems, and the basic object of this invention is to provide a light weight heat-resistant alloy with improved workability in plastic working by increasing the ductility of Ti-Al alloys in which the main constituent phase is the intermetallic compound, TiAl.

Another object of this invention is to improve the ductility of Ti-Al alloys in which the main constituent phase is the intermetallic compound, TiAl, so as to facilitate the plastic working, and further, to provide a light weight heat-resistant alloy with improved workability in plastic working and mold casting by increasing the ductility and lowering the melting point of the Ti-Al alloys in which the main constituent is the intermetallic compound, TiAl.

The Ti-Al alloys having the increased ductility of this invention essentially consists of Al: 28–38% and B: 0.005–0.3% and the balance being Ti with inevitable impurities.

The Ti-Al alloy having the increased ductility and lowered melting point of this invention essentially consists of Al: 28–38%, one or two of Ni: 0.05–3.0% and Si: 0.05–3.0%, and optionally, B: 0.005–0.3%, the balance being Ti and inevitable impurities.

In the above alloy compositions, if a better ductility at a lower temperature is desired, it is necessary to chose a low Al-content, and if the ductility at a higher temperature is more important, it is advisable to chose an Al-content of 32% or more. It is preferable that amounts of the impurities are in the following range: C: up to 0.2%, O: up to 0.3% and N: up to 0.3%, whereby O +N: up to 0.4%.

As the means for producing desired structural parts with the Ti-Al alloys of this invention, casting as well as forging can be used.

DETAILED EXPLANATION OF PREFERRED EMBODIMENTS

Selection of the above described composition of the Ti-Al alloys according to the present invention is based on the following reasons:

Al: 28–38%

The stoichiometric composition of the intermetallic compound, TiAl (gamma-phase), is Al: 36%, and the range in which single phase TiAl can exist in the binary alloys is Al: 34–42%. However, in case where Al exceeds 38%, the ductility decreases contrary to the object of this invention, and therefore, 38% is selected as the upper limit. On the other hand, in case where the composition is rich of Ti, or Al is less than 34%, $Ti_3Al$ ($alpha_2$-phase) is formed. This compound enhances the ductility of the alloy at a lower temperature, and therefore, in case where a good cold ductility is desired, the Al-content range of 28–34% is recommended. Also, this compound, when the content is small, is useful to improve the high temperature ductility. However, $Ti_3Al$ itself is brittle, the alloy will lose ductility as the amount thereof increases. Thus, in case where a good hot workability is required, the Al-content range of 32–38% is preferable. Also, Al lowers the melting point of the alloy, like boron, nickel and silicon mentioned below.

B: 0.005–0.3%

Boron increases ductility by strengthening the grain boundary of TiAl compound and also contributes to improvement in the strength by grain refinement. This effect may be obtained by addition of an amount as small as 0.005%. On the other hand, when the amount increases, boron will induce the formation of brittle borides, thus reducing the ductility. Hence, 0.3% is selected as the upper limit. Also, boron is, like nickel and silicon mentioned below, effective for lowering the melting point of the present alloys.

Ni: 0.05–3.0%, Si: 0.05–3.0%

Both nickel and silicon dissolve in TiAl phase and increase ductility. This effect is appreciable at the contents as low as 0.05%. On the other hand, the amounts of nickel and silicon which can be dissolved in TiAl phase are limited to 3.0%, and excess addition causes decrease in the ductility. Thus, the upper limits of these elements are determined to be 3.0%. Nickel and silicon are effective for lowering the melting temperature of the present alloy.

C: up to 0.2%

Carbon forms Ti-carbide, TiC, which improves the strength of the alloy, but carbon decreases the ductility of the alloy. Thus, 0.2% is selected as the upper limit.

O: up to 0.3%, N: up to 0.3% preferably up to 0.2%, whereby, O+N: up to 0.4%

Both oxygen and nitrogen are dissolved in TiAl and strengthen it. They, however, decrease the ductility of the alloy, and the above upper limits are determined from this point of view. If a better strength is desired for the alloy, the impurities are rather useful, and therefore, positive addition in the above noted range is preferable. On the other hand, if the alloy should have a higher ductility, the amounts of these impurities must be as low as possible.

According to the present invention, ductility of Ti-Al alloys having high heat-resistant property and a high specific strength is improved and the workability of plastic working is thus improved. The lowered melting points of the alloys result in higher castability and facilitate precision casting. Therefore, various mechanical parts of rotating or reciprocating systems such as blades of aircraft jetengines and gasturbines for industrial use, intake and exhaust valves, locker arms, connecting rods and hot wheels of turbochargers for motorcycle and automobile engines can be easily produced by forging or casting.

Easier working also results in reduction of problems in reliability of the products due to difficulties in processing the material.

EXAMPLES

Example 1

Ti-Al alloys with the composition described in Table 1 were prepared. Melting was carried out under argon gas atmosphere by plasma arc in a skull furnace with a water-cooled copper crucible. Runs Nos. 1–9 are examples of the present invention, and Runs Nos. 10–12 are control examples according to the conventional method included for comparison.

Test-pieces were cut out of the ingots of the alloys, and subjected to tensile tests at 900° C. The results are shown in Table 2. It is obvious that alloys of this invention have improved ductility.

Alloy No. 2 was subjected to 30% and 50% upsetting at 1150° C. There was no visible crack on the test-piece surface even at 50% upsetting.

TABLE 1

| | | Alloy Composition (wt %, balance Ti) | | | | |
|---|---|---|---|---|---|---|
| No. | Al | B | C | O | N | Others |
| Present Invention | | | | | | |
| 1 | 35.4 | 0.009 | — | — | — | — |
| 2 | 35.3 | 0.050 | — | — | — | — |
| 3 | 35.3 | 0.122 | — | — | — | — |
| 4 | 33.8 | 0.051 | — | — | — | — |
| 5 | 37.1 | 0.062 | — | — | — | — |
| 6 | 29.5 | 0.053 | — | — | — | — |
| 7 | 35.2 | 0.066 | 0.117 | — | — | — |
| 8 | 35.5 | 0.063 | — | 0.180 | — | — |
| 9 | 35.3 | 0.054 | — | — | 0.173 | — |
| Control | | | | | | |
| 10 | 35.0 | — | — | — | — | — |
| 11 | 34.9 | — | — | — | — | V: 1.91 |
| 12 | 34.1 | — | — | — | — | Mn: 2.17 |

TABLE 2

| | Tensile Test Results | | |
|---|---|---|---|
| No. | Tensile Strength Kgf/mm$^2$ | Elongation % | Reduction of Area % |
| Present Invention | | | |
| 1 | 30.4 | 8.7 | 9.1 |
| 2 | 30.3 | 53.0 | 42.1 |
| 3 | 31.2 | 32.4 | 26.4 |
| 4 | 34.6 | 35.4 | 23.7 |
| 5 | 29.4 | 33.7 | 27.8 |
| 6 | 35.6 | 8.5 | 8.0 |
| 7 | 39.3 | 32.6 | 25.3 |
| 8 | 38.6 | 35.4 | 29.4 |
| 9 | 37.4 | 34.3 | 24.2 |
| Control | | | |
| 10 | 24.3 | 6.7 | 5.0 |
| 11 | 22.0 | 0.5 | 0 |
| 12 | 21.5 | 1.5 | 0.5 |

Example 2

Ti-Al alloys of the composition shown in Table 3 were prepared in the same way as described in Example 1. Runs Nos. 13–25 are examples according to the present invention, and Runs Nos. 26 and 27 are control examples for comparison.

Test-prices cut out from the cast ingots of the alloys were subjected to tensile tests at 900° C. and measurement of the melting points (liquidus and solidus) by differential thermal analysis.

The results are shown in Table 4. It is understood from Table 4 that the present alloys have increased ductility and lowered melting points.

Alloy No. 23 was subjected to 30% and 50% upsetting at 1150° C. No crack appeared on the test-piece even in case of 50% upset.

Using the alloys Nos. 23 and 25 and ceramics molds made by lost-wax method, hot wheels for turbochargers were cast. There was observed defects on the blades of the hot wheels cast with control alloy No. 25 due to chemical reaction between the mold and the molten TiAl, and hence, no sound product was obtained. On the other hand, the hot wheels made of alloy No. 23 according to the present invention were sound products without defects.

TABLE 3

| | | Alloy Composition (wt %, balance Ti) | | | | | |
|---|---|---|---|---|---|---|---|
| No. | Al | Si | Ni | B | C | O | N |
| Present Invention | | | | | | | |
| 13 | 34.72 | 0.52 | — | — | 0.012 | 0.051 | 0.007 |
| 14 | 35.77 | 0.97 | — | — | 0.011 | 0.052 | 0.006 |
| 15 | 35.99 | 1.79 | — | — | 0.014 | 0.061 | 0.007 |
| 16 | 36.35 | — | 0.25 | — | 0.017 | 0.096 | 0.021 |
| 17 | 36.34 | — | 0.67 | — | 0.014 | 0.085 | 0.028 |
| 18 | 36.35 | — | 1.38 | — | 0.011 | 0.089 | 0.007 |
| 19 | 33.34 | 0.33 | 0.35 | — | 0.019 | 0.122 | 0.009 |
| 20 | 35.36 | 0.59 | 0.36 | — | 0.018 | 0.090 | 0.009 |
| 21 | 27.92 | 0.32 | 0.21 | 0.05 | 0.023 | 0.095 | 0.028 |
| 22 | 35.47 | 0.35 | — | 0.08 | 0.045 | 0.130 | 0.007 |
| 23 | 35.28 | — | 0.27 | 0.04 | 0.019 | 0.075 | 0.012 |
| 24 | 37.21 | — | 0.47 | 0.16 | 0.037 | 0.103 | 0.030 |
| 25 | 35.30 | 0.36 | 0.54 | 0.06 | 0.020 | 0.083 | 0.024 |

TABLE 3-continued

| No. | Al | Si | Ni | B | C | O | N |
|---|---|---|---|---|---|---|---|
| | | Alloy Composition (wt %, balance Ti) | | | | | |
| Control | | | | | | | |
| 26 | 35.00 | — | — | — | — | — | — |
| 27 | 34.90 | — | — | — | — | — | — |
| | | V: 1.91 | | | | | |

TABLE 4

| No. | Tensile Properties: Tensile Strength Kgf/mm$^2$ | Elongation % | Reduction of Area % | Melting Point: Liquidus ° C. | Solidus ° C. |
|---|---|---|---|---|---|
| Present Invention | | | | | |
| 13 | 36.3 | 42.6 | 56.8 | 1492 | 1437 |
| 14 | 29.3 | 44.2 | 58.5 | 1472 | 1421 |
| 15 | 27.8 | 9.0 | 8.6 | 1445 | 1397 |
| 16 | 28.9 | 40.8 | 40.1 | 1494 | 1440 |
| 17 | 36.3 | 44.2 | 58.5 | 1484 | 1426 |
| 18 | 23.3 | 9.1 | 8.8 | 1468 | 1403 |
| 19 | 30.8 | 15.3 | 13.6 | 1499 | 1433 |
| 20 | 29.8 | 34.9 | 30.9 | 1478 | 1421 |
| 21 | 37.5 | 8.9 | 8.0 | 1506 | 1437 |
| 22 | 35.5 | 36.2 | 31.9 | 1482 | 1427 |
| 23 | 30.3 | 53.0 | 42.1 | 1492 | 1433 |
| 24 | 32.6 | 25.3 | 20.3 | 1462 | 1407 |
| 25 | 30.4 | 57.6 | 49.3 | 1463 | 1405 |
| Control | | | | | |
| 26 | 24.3 | 6.7 | 5.0 | 1503 | 1451 |

TABLE 4-continued

| No. | Tensile Properties: Tensile Strength Kgf/mm$^2$ | Elongation % | Reduction of Area % | Melting Point: Liquidus ° C. | Solidus ° C. |
|---|---|---|---|---|---|
| 27 | 22.0 | 0.5 | 0 | 1513 | 1469 |

We claim:

1. A Ti-Al alloy having increased ductility essentially consisting of Al: 28–38% and B: 0.005–0.16%, the balance being Ti and inevitable impurities.

2. A Ti-Al alloy having increased ductility essentially consisting of Al: 28–38%, Ni: 0.05–3.0% and Si: 0.05–3.0%, and the balance being Ti and inevitable impurities.

3. A Ti-Al alloy essentially consisting of Al: 28–38%, one or two of Ni: 0.05–3.0% and Si: 0.05–3.0%, and further, B: 0.005–0.3%, the balance being Ti and inevitable impurities.

4. A Ti-Al alloy according to one of claims 1–3, wherein the amounts of the impurities are in the ranges below:

C: up to 0.2%, O: up to 0.3%, N: up to 0.3%, whereby O+N: up to 0.4%.

5. Articles made from the alloys of claim 4 comprising one of blades of aircraft jet engines and gas turbines for industrial use, intake and exhaust valves, locker arms, connecting rods and hot wheels of turbocharger for motocycle and automobile engines.

6. Articles made from the alloys of one of claims 1-3 comprising one of blades of aircraft jet engines and gas turbines for industrial use, intake and exhaust valves, locker arms, connecting rods and hot wheels of turbocharger for motorcycle and automotible engines.

* * * * *